US006868997B1

(12) United States Patent
Maguire

(10) Patent No.: US 6,868,997 B1
(45) Date of Patent: Mar. 22, 2005

(54) COMBINATION SHOEHORN, SHOE COUNTER CLIP AND SOCK APPLIER

(76) Inventor: Mark T. Maguire, 4869 Robin Hill Dr., Omaha, NE (US) 68106

( * ) Notice: Subject to any disclaimer, the term of this patent is extended or adjusted under 35 U.S.C. 154(b) by 74 days.

(21) Appl. No.: 10/393,628

(22) Filed: Mar. 20, 2003

Related U.S. Application Data

(63) Continuation-in-part of application No. 10/159,760, filed on May 30, 2002, now Pat. No. 6,698,630.

(51) Int. Cl.[7] ..... A47G 25/82
(52) U.S. Cl. ..... 223/118; 223/112; 223/113
(58) Field of Search ..... 223/111, 112, 223/118, 119

(56) References Cited

U.S. PATENT DOCUMENTS

| | | | | | |
|---|---|---|---|---|---|
| 470,109 | A | | 3/1892 | Dickinson | |
| 2,939,618 | A | * | 6/1960 | Mangles | 223/113 |
| 3,165,246 | A | | 1/1965 | Stearns | 223/118 |
| 3,692,217 | A | | 9/1972 | Smith | 223/111 |
| 3,883,052 | A | | 5/1975 | Wilson | 223/111 |
| D310,908 | S | | 10/1990 | Santore | D2/642 |
| 5,636,774 | A | | 6/1997 | Moscato | 223/112 |
| 5,655,693 | A | | 8/1997 | Engelman et al. | 223/119 |
| 5,706,988 | A | * | 1/1998 | Moore | 223/111 |

* cited by examiner

*Primary Examiner*—John J. Calvert
*Assistant Examiner*—James Smith
(74) *Attorney, Agent, or Firm*—Thomte, Mazour & Niebergall; Dennis L. Thomte

(57) ABSTRACT

A combination shoehorn, shoe counter clip and sock applier is disclosed which comprises a generally U-shaped funnel portion having a pair of elongated handles secured thereto and extending upwardly and outwardly from opposite sides thereof. The counter clip is secured to the outer rearward surface of the funnel portion with the upper end thereof extending above the upper rearward end of the funnel portion to define a sock support. The counter clip is secured to the funnel portion in such a way so as to create a space therebetween at the lower end of the counter clip and the funnel portion. When the device is used to assist in placement of a shoe on the person's foot, the counter of the shoe is positioned within the space between the counter clip and the funnel portion so that the individual is able to maneuver the shoe as required since the shoe is securely held in the space between the counter clip and the funnel portion. The device may also be used to assist a person in donning his or her socks. In such a case, the funnel portion and the counter clip are inserted into the open upper end of a sock with a portion of the sock being placed over the upper end of a counter clip to securely attach the sock to the device. The device may then be maneuvered to pull the sock upwardly onto the person's foot through the use of the elongated handles.

15 Claims, 4 Drawing Sheets

COMBINATION SHOEHORN, SHOE COUNTER CLIP AND SOCK APPLIER

CROSS-REFERENCE TO RELATED APPLICATION

This is a continuation-in-part application of Petitioner's earlier application Ser. No. 10/159,760 filed May 30, 2002, now U.S. Pat. No. 6,698,630 entitled A COMBINATION SHOEHORN AND SHOE COUNTER CLIP.

BACKGROUND OF THE INVENTION

1. Field of the Invention

This invention relates to a combination shoehorn and shoe counter clip to enable a person to put on their shoes. The invention also may be used to apply one's socks.

2. Description of the Related Art

Donning a pair of shoes is a simple task which most people take for granted. A significant number of people have difficulty donning their shoes, for example, the elderly, the physically challenged and the obese. Deficits, such as extreme low back pain, compromised dexterity-flexibility-coordination, and upper extremity paresis, can complicate the task of donning shoes. Typical short or long shoehorns have many shortcomings and are not ideally suited for assisting a person such as those described above who has difficulty donning their shoes. People having the infirmities described above have attempted to don their shoes using the traditional long plastic shoehorn, but find it difficult to properly place their heel on the narrow plastic device, allowing the heel to lose contact and slip off. For an individual attempting to overcome physical barriers, this can be a frustrating and discouraging task. Further, many people lack the coordination to keep a traditional shoehorn positioned inside the counter of the shoe. This task is even further complicated when the person attempts to use a short shoehorn.

The invention of the co-pending application solved many of the problems discussed hereinabove. The instant application provides a device which represents an improvement over the earlier device. Further, the instant invention may be used to apply one's socks.

SUMMARY OF THE INVENTION

A combination device for use in positioning a person's foot in a shoe including a counter with an upper rearward end having rearward and forward sides, or for use in applying a sock to a person's foot. The invention comprises an arcuate, generally U-shaped funnel portion having an upper end, a lower end, a rearward side, a forward side and first and second side portions having inner and outer surfaces. A first elongated handle is secured to the first side portion and extends upwardly and outwardly therefrom. A second elongated handle is secured to the second side portion and extends upwardly and outwardly therefrom. A counter clip having rearward and forward sides, an upper end and a lower end is secured to the funnel portion so as to be positioned adjacent the rearward side thereof and to define an area therebetween adjacent the lower end of the counter clip into which the upper rearward end of a shoe counter may be selectively removably placed to enable a person to maneuver the shoe by grasping one or more of the elongated members. The lower end of the funnel portion is received within the shoe counter when the upper rearward end of the shoe counter is positioned between the funnel portion and the counter clip.

The upper end of the counter clip is positioned above the upper rearward end of the funnel portion to define a sock support. When the device is being used to apply an elastic sock to a person's foot, the funnel portion is received within the sock so that a portion of the sock may be placed over the upper end of the counter clip to selectively removably support the sock on the device to assist a person to pull the sock onto the person's foot.

When the device is being used to apply an inelastic sock to a person's foot, the lower end of the funnel portion is received within the sock so that the upper rearward end of the inelastic sock is positioned between the upper and lower ends of the counter clip.

The device of this invention is effective for individuals capable of bending over while sitting and more importantly may be successively used by individuals not capable of bending over due to conditions such as low back pain, obesity, etc.

It is therefore a principal object of the invention to provide an improved combination device for positioning a person's foot in a shoe or for applying one's socks.

A further object of the invention is to provide a combination device of the type described above which enables a person having physical infirmities to don their shoes or don their socks.

Still another object of the invention is to provide a device which clips onto the counter of the shoe and which includes a funnel portion or horn portion which extends downwardly into the shoe adjacent the forward side of the counter to guide the person's foot into the shoe with a pair of elongated handles extending upwardly and outwardly from the funnel portion.

These and other objects will be apparent to those skilled in the art.

DESCRIPTION OF THE PREFERRED EMBODIMENT

The numeral 10 refers generally to the combination shoehorn, shoe counter clip and sock applier of this invention while the numeral 12 refers to a conventional shoe which includes a counter 14 at its rearward end with the counter having an upper end, and rearward and forward sides.

Figure 1:
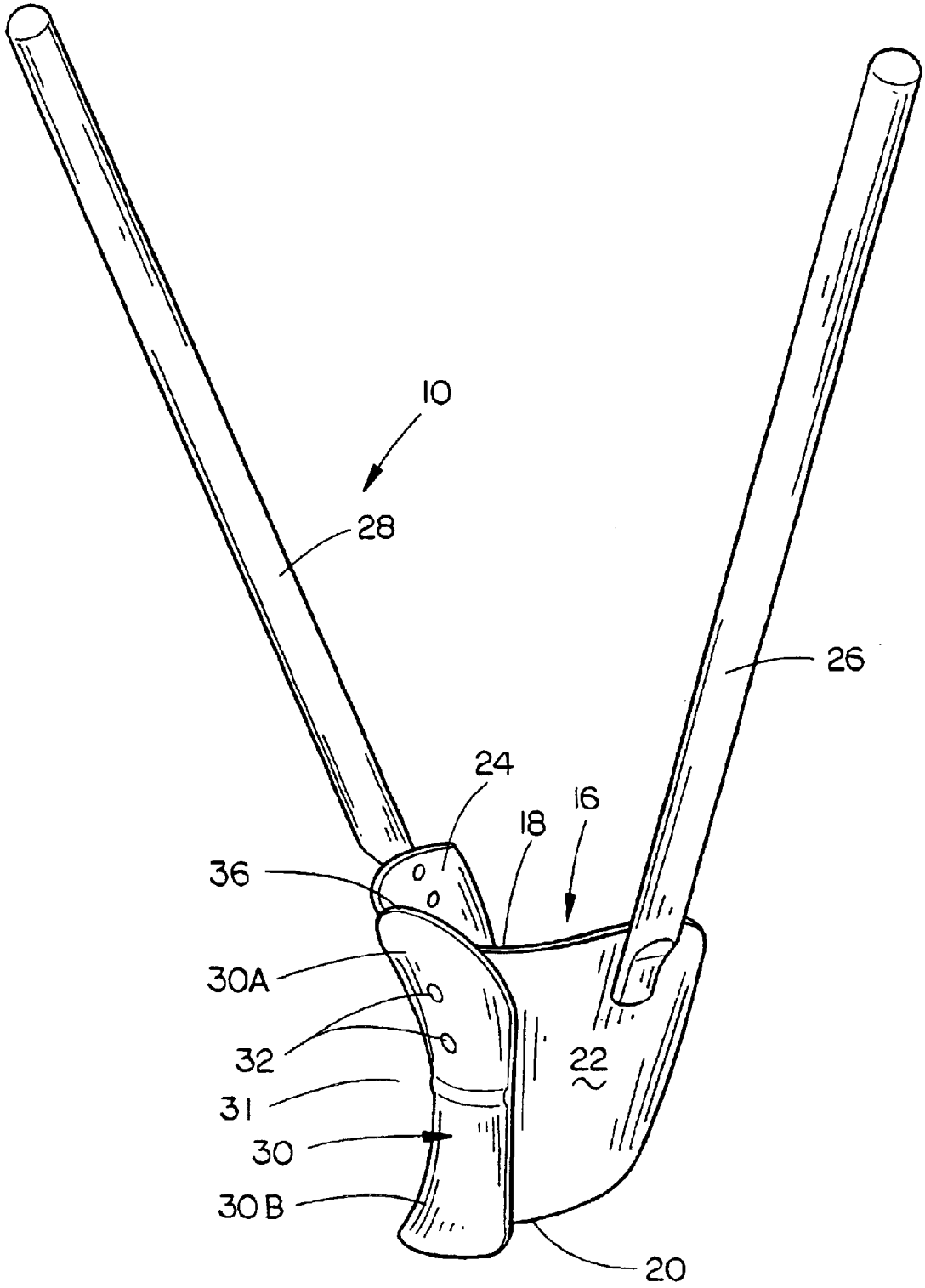
FIG. 1 is a rear perspective view of the combination device of this invention.
Figure 2:
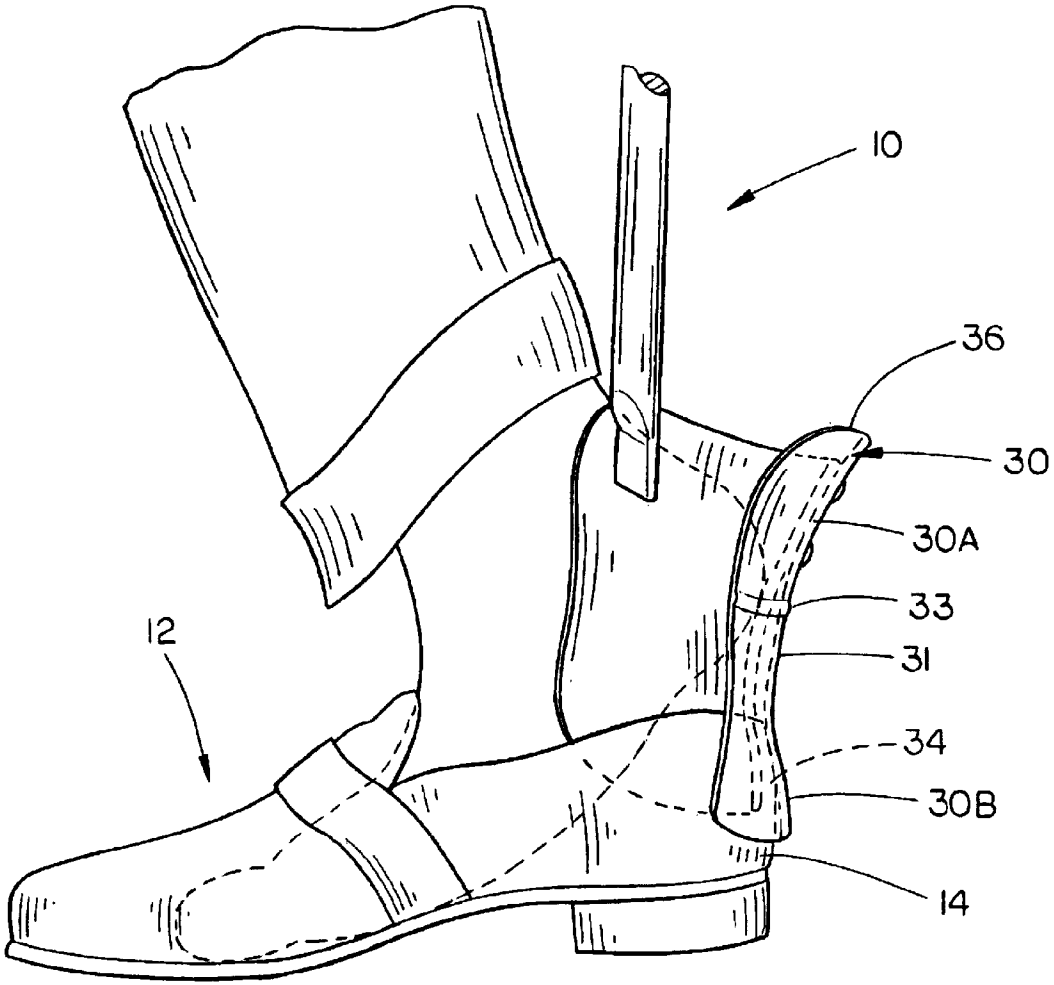
FIG. 2 is a side elevational view illustrating the device being used to insert a person's foot into a shoe.

Preferably, the device is comprised of a plastic material although it is possible that other materials could be used to form the device. Device 10 includes a generally U-shaped funnel portion 16 having an upper end 18, lower end 20, side portions 22 and 24 and a rearward portion positioned therebetween. An elongated handle 26 is secured at its lower end to side portion 22 adjacent the upper end thereof and extends upwardly and outwardly therefrom. Likewise, an elongated handle 28 is secured at its lower end to side portion 24 at the upper end thereof and extends upwardly and outwardly therefrom. The numeral 30 refers to a counter clip which is arcuate in cross section and which is secured to the rearward side of the rearward portion which extends between the side portions 22 and 24 of the funnel portion 16 by rivets 32 or the like. Generally speaking, counter clip 30 includes an upper portion 30A and a lower portion 30B with the junction therebetween being referred to by the reference numeral 31. If the counter clip is of the molded arcuate shape seen in the drawings, it is preferred that the arcuate counter clip 30 be provided with a protruding ridge 33 which is located closely adjacent the junction 31. The cross section of counter clip 30 could be rectangular rather than arcuate. If the counter clip 30 is flat and rectangular rather than arcuate, the upper portion thereof will be angularly disposed with respect to the lower portion thereof, the junction thereof will eliminate the need for the protruding ridge. The lower end of counter clip 30 is positioned closely adjacent the funnel portion 22 and is sufficiently flexible to define a space 34 therebetween which is adapted to receive the upper portion of the counter 14, as illustrated in FIG. 2, to grip the shoe therebetween. The upper end 36 of counter clip 30 is positioned above the upper end of funnel portion 16 to provide a sock support as will be described hereinafter.

To use the device 10, the individual places the shoe 12 on their lap and clips the device 10 to the counter 14 of the shoe. The clipping action is achieved by the counter clip 30 being positioned rearwardly of the counter 14 of the shoe with the lower rearward end of the funnel portion 16 being received within the shoe, as illustrated in FIG. 2. As seen in the drawings, the lower end of the funnel portion 16 has a width which is less than the width of the upper end of the funnel portion 16 so that the funnel portion 16 "funnels" the person's heel into the shoe as seen in FIG. 2. When the device has been clipped onto the shoe, as illustrated in the drawings, the individual then uses the elongated handles 26 and 28 to place the shoe on the ground in the desired position. While still holding the handles, the individual places their toes into the shoe, as illustrated in FIG. 2. At this point, the individual is able to let go of one of the handles and use their free hand to hold the tongue, if the shoe includes a tongue, to prevent it from collapsing into the shoe providing the individual is able to reach the tongue. While pushing their foot into the shoe, the funnel shape of the funnel portion 16 acts to guide the uncontrolled and sometimes unseen heel into the shoe. Once the heel is funneled into the shoe, the individual uses one or more of the handles 26 and 28 to pull the device out of the shoe. Donning of the shoe is now complete.

Figure 3:
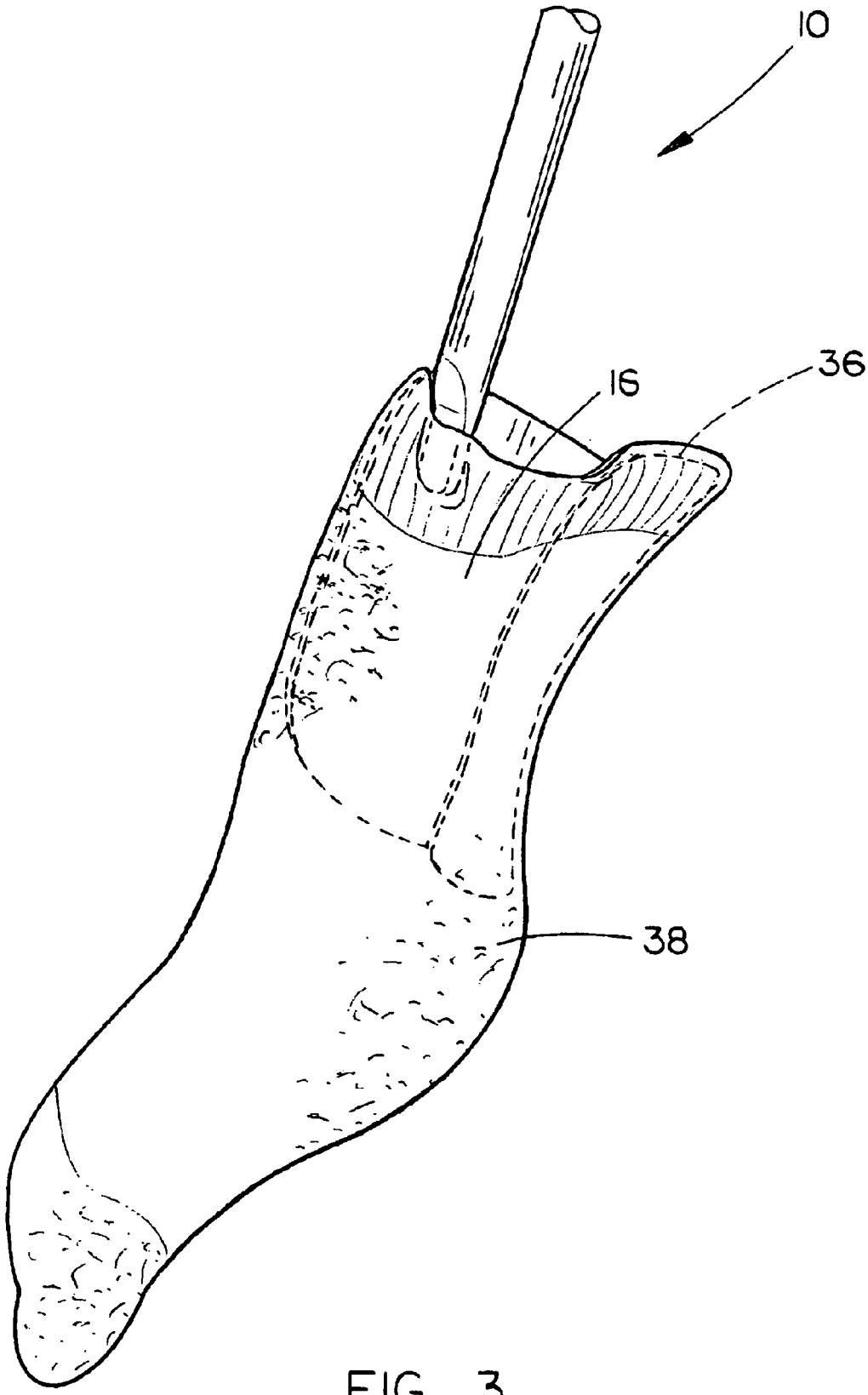
FIG. 3 is a perspective view illustrating the device supporting a sock.
Figure 4:
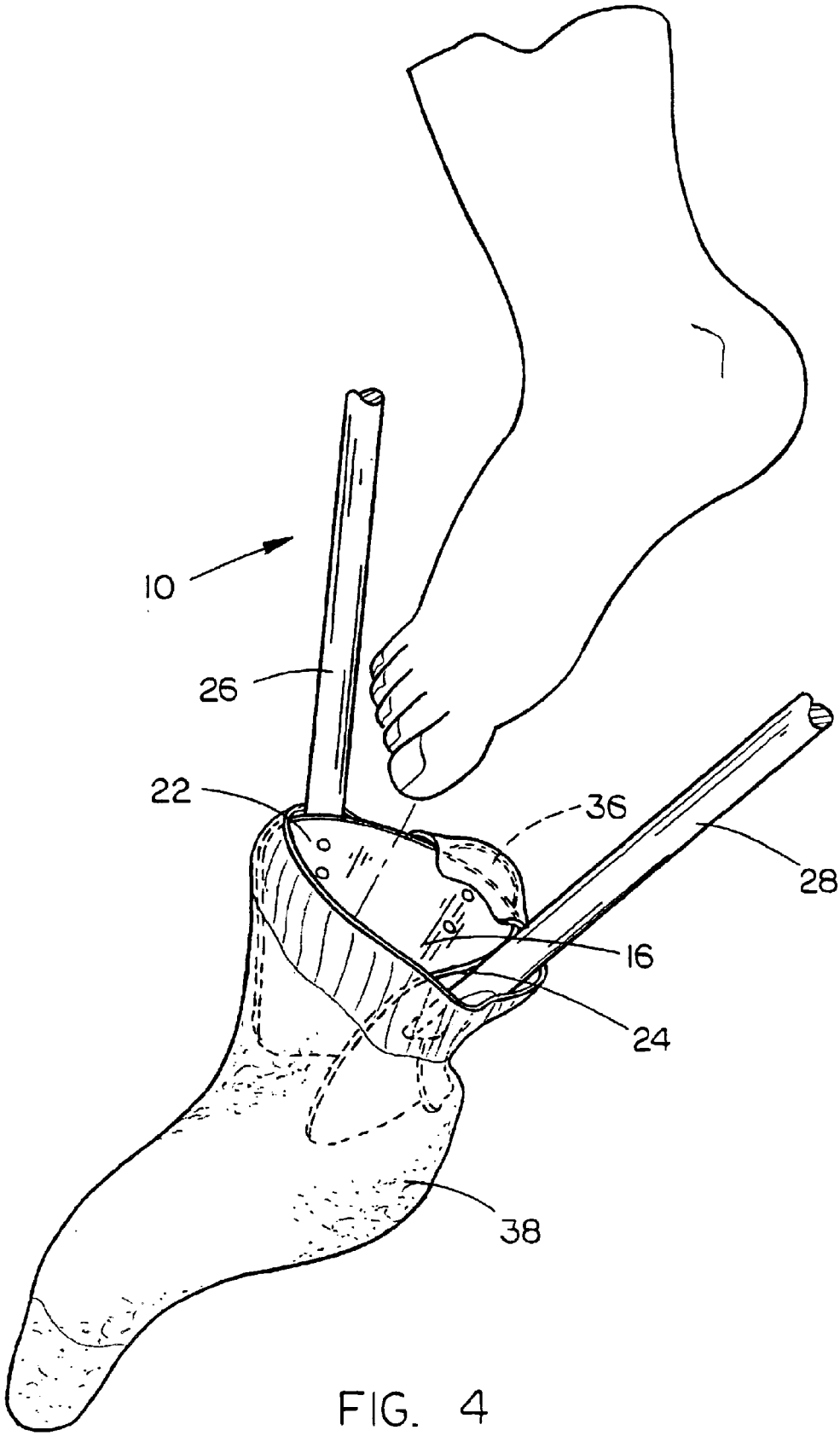
FIG. 4 is a perspective view illustrating a person inserting his or her foot into the sock while it is being held by the device.

As seen in FIGS. 3 and 4, the device 10 may be also used to support an elastic sock to assist a person to apply the sock to the person's foot. As seen in FIG. 4, the funnel portion 16 is inserted downwardly into the open upper end of the elastic sock 38. A portion of the elastic sock is then pulled upwardly over the upper end 36 of the counter 30 and folded forwardly thereover, as illustrated in FIG. 4. The elastic sock 38 is also preferably positioned over the upper forward ends of sides 22 and 24, as illustrated in FIG. 4. The device then effectively supports the elastic sock and maintains the upper end thereof in an open condition so that the sock may be pulled upwardly onto the person's foot through the use of the handles 26 and 28. Once the sock has been pulled upwardly onto the person's foot through the use of the handles 26 and 28, device 10 is then pulled upwardly out of the sock. If the sock is inelastic, the upper end thereof may not be able to be pulled up to the position illustrated in FIG. 3. In that case, the upper end of the inelastic sock is pulled up over the ridge 33 if the counter dip 30 is arcuate or up to the junction of the upper and lower portions thereof if the counter clip is flat, rectangular and angled as described.

Thus it can be seen that the combination device of this invention accomplishes at least all of its stated objectives.

I claim:

1. A device for use in positioning a person's foot in a shoe including a counter with an upper rearward end having rearward and forward sides, comprising:

an arcuate, generally U-shaped funnel portion having an upper end, a lower end, a rearward side and a forward side and first and second side portions having inner and outer surfaces;

a first elongated handle extending upwardly and outwardly from said first side portion;

a second elongated handle extending upwardly and outwardly from said second side portion;

said first and second elongated handles diverging outwardly away from one another;

a counter clip having rearward and forward sides, an upper end and a lower end;

said counter dip being secured to said funnel portion so as to be positioned adjacent said rearward side thereof and to define an area therebetween at the lower end of said counter clip into which the upper rearward end of the shoe counter may be selectively removably placed to enable a person to maneuver the shoe by grasping one or more of said elongated members;

said lower end of said funnel portion being received within the shoe counter when the upper rearward end of the shoe counter is positioned within said space.

2. The device of claim 1 wherein said lower end of said counter clip is sufficiently flexible so as to securely engage the shoe counter when the shoe counter is positioned in said area.

3. The device of claim 1 wherein said counter clip is secured to said funnel portion above the lower end of said counter clip to define said area.

4. The device of claim 1 wherein said lower end of said counter clip has a cross section generally complementary to the cross section of said rearward side of said funnel portion.

5. The device of claim 1 wherein said elongated members extend upwardly and outwardly with respect to said sides of said funnel portion.

6. The device of claim 1 wherein said funnel portion and said counter clip are comprised of a plastic material.

7. A device for use in applying a sock to a person's foot, comprising:

an arcuate, generally U-shaped funnel portion having an upper end, a lower end, a rearward side and a forward side and first and second side portions having inner and outer surfaces;

a first elongated handle extending upwardly from said first side portion;

a second elongated handle extending upwardly from said second side portion;

a support having upper and lower ends, an upper portion and a lower portion;

said support being secured to said funnel portion so as to be positioned adjacent said rearward side thereof so that said upper end of said support is positioned above said upper end of said rearward side of said funnel portion to define a sock support;

said funnel portion being received within the sock to permit a portion of the sock to be placed over said sock support to selectively removably support the sock on the device to assist a person to pull the sock onto the person's foot.

8. The device of claim 7 wherein said upper end of said support is arcuate.

9. The device of claim 7 wherein said upper end of said support has a cross section generally complementary to the cross section of said rearward side of said funnel portion.

10. A combination device for use in positioning a person's foot in a shoe including a counter with an upper rearward end having rearward and forward sides, or for use in applying a sock to a person's foot, comprising:

an arcuate, generally U-shaped funnel portion having an upper end, a lower end, a rearward side and a forward side and first and second side portions having inner and outer surfaces;

a first elongated handle extending upwardly and outwardly from said first side portion;

a second elongated handle extending upwardly and outwardly from said second side portion;

said first and second elongated handles diverging outwardly away from each other;

a counter clip having rearward and forward sides, an upper end and a rearward end;

said counter clip being secured to said funnel portion so as to be positioned adjacent said rearward side thereof and to define an area therebetween at the lower end of said counter clip into which the upper rearward end of the shoe counter may be selectively removably placed to enable a person to maneuver the shoe by grasping one or more of said elongated members;

said lower end of said funnel portion being received within the shoe counter when the upper rearward end of the shoe counter is positioned within said space;

said funnel portion being received within the sock to permit a portion of the sock to be placed over said sock support to selectively removably support the sock on the device to assist a person to pull the sock onto the person's foot.

11. A combination device for use in positioning a person's foot in a shoe including a counter with an upper rearward end having rearward and forward sides, or for use in applying a sock to a person's foot, comprising:

an arcuate, generally U-shaped funnel portion having an upper end, a lower end, a rearward side and a forward side and first and second side portions having inner and outer surfaces;

a first elongated handle extending upwardly from said first side portion;

a second elongated handle extending upwardly from said second side portion;

a counter clip having rearward and forward sides, an upper end and a rearward end;

said counter clip being secured to said funnel portion so as to be positioned adjacent said rearward side thereof and to define an area therebetween at the lower end of said counter clip into which the upper rearward end of the shoe counter may be selectively removably placed to enable a person to maneuver the shoe by grasping one or more of said elongated members;

said lower end of said funnel portion being received within the shoe counter when the upper rearward end of the shoe counter is positioned within said space;

said funnel portion being received within the sock to permit a portion of the sock to be placed over said sock support to selectively removably support the sock on the device to assist a person to pull the sock onto the person's foot;

said counter clip having an upper end portion and a lower end portion which are angled with respect to one another.

12. The combination device of claim 11 wherein a protruding ridge is provided on the rearward side of said counter clip generally between said upper end portion and said lower end portion.

13. A device for use in positioning a person's foot in a shoe including a counter with an upper rearward end having rearward and forward sides, comprising:

an arcuate, generally U-shaped funnel portion having an upper end, a lower end, a rearward side and a forward side and first and second side portions having inner and outer surfaces;

a first elongated handle extending upwardly from said first side portion;

a second elongated handle extending upwardly from said second side portion;

a counter clip having rearward and forward sides, an upper end and a lower end;

said counter dip being secured to said funnel portion so as to be positioned adjacent said rearward side thereof and to define an area therebetween at the lower end of said counter dip into which the upper rearward end of the shoe counter may be selectively removably placed to enable a person to maneuver the shoe by grasping one or more of said elongated members;

said lower end of said funnel portion being received within the shoe counter when the upper rearward end of the shoe counter is positioned within said space;

said upper end of said counter clip being positioned above said upper end of said rearward side of said funnel portion.

14. A device for use in applying a sock to a person's foot, comprising:

an arcuate, generally U-shaped funnel portion having an upper end, a lower end, a rearward side and a forward side and first and second side portions having inner and outer surfaces;

a first elongated handle extending upwardly from said first side portion;

a second elongated handle extending upwardly from said second side portion;

a support having upper and lower ends, an upper portion and a lower portion;

said support being secured to said funnel portion so as to be positioned adjacent said rearward side thereof so that said upper end of said support is positioned above said upper end of said rearward side of said funnel portion to define a sock support;

said funnel portion being received within the sock to permit a portion of the sock to be placed over said sock support to selectively removably support the sock on the device to assist a person to pull the sock onto the person's foot;

said support being secured to said funnel portion to define an area therebetween at the lower end of said support into which the upper rearward end of a shoe counter may be selectively removably placed to enable a person to maneuver a shoe by grasping one or more of said elongated members, said lower end of said funnel portion being received within the shoe counter when the upper rearward end of the shoe counter is positioned within the said area.

15. A combination device for use in positioning a person's foot in a shoe including a counter with an upper rearward end having rearward and forward sides, or for use in applying a sock to a person's foot, comprising:

an arcuate, generally U-shaped funnel portion having an upper end, a lower end, a rearward side and a forward side and first and second side portions having inner and outer surfaces;

a first elongated handle extending upwardly from said first side portion;

a second elongated handle extending upwardly from said second side portion;

a counter clip having rearward and forward sides, an upper end and a rearward end;

said counter clip being secured to said funnel portion so as to be positioned adjacent said rearward side thereof and to define an area therebetween at the lower end of said counter clip into which the upper rearward end of the shoe counter may be selectively removably placed to enable a person to maneuver the shoe by grasping one or more of said elongated members;

said lower end of said funnel portion being received within the shoe counter when the upper rearward end of the shoe counter is positioned within said space;

said funnel portion being received within the sock to permit a portion of the sock to be placed over said sock support to selectively removably support the sock on the device to assist a person to pull the sock onto the person's foot;

said upper end of said counter clip being positioned above said upper end of said rearward side of said funnel portion to define sock support.

* * * * *